US006072272A

United States Patent [19]

Rumbaugh

[11] Patent Number: 6,072,272

[45] Date of Patent: Jun. 6, 2000

[54] COLOR FLAT PANEL DISPLAY DEVICE

[75] Inventor: Rob Rumbaugh, Scottsdale, Ariz.

[73] Assignee: Motorola, Inc., Schaumburg, Ill.

[21] Appl. No.: 09/072,443

[22] Filed: May 4, 1998

[51] Int. Cl.[7] ..... H01J 29/30

[52] U.S. Cl. ..... 313/470; 313/495

[58] Field of Search ..... 313/470, 471, 313/472, 461, 422, 462; 359/893

[56] References Cited

U.S. PATENT DOCUMENTS

| | | | |
|---|---|---|---|
| 4,193,015 | 3/1980 | Barten | 313/470 X |
| 4,220,892 | 9/1980 | Van Raalte | 313/470 X |
| 5,045,750 | 9/1991 | Itou et al. | 313/461 X |
| 5,311,337 | 5/1994 | McCartney, Jr. . | |
| 5,317,437 | 5/1994 | Katakura . | |
| 5,467,422 | 11/1995 | Itihara et al. . | |
| 5,565,754 | 10/1996 | Pietrzak . | |
| 5,654,729 | 8/1997 | Garcia . | |

*Primary Examiner*—Ashok Patel
*Attorney, Agent, or Firm*—Jasper Dockrey; Kevin D. Wills

[57] ABSTRACT

A flat panel display device includes a cathode (58) in parallel opposed position to and vertically separated from an anode (56). Red (46), green (44), and blue (42) subpixels are sequentially arrayed on the anode (56). Electron emitter subpixels (50, 52, 54) are arrayed on the cathode (58) in paired relationship to the red, green, and blue subpixels (46, 44, 42) located on the anode (56). To provide enhanced color performance, the surface area of the blue subpixel (42) is greater than the surface area of either the green subpixel (44) or the red subpixel (46). Additionally, the red subpixel (46) is horizontally shifted toward the green subpixel (44) and away from the blue subpixel (42).

10 Claims, 3 Drawing Sheets

—PRIOR ART—

—PRIOR ART—

11

COLOR FLAT PANEL DISPLAY DEVICE

FIELD OF THE INVENTION

This invention relates, in general, to flat panel display devices, and more particularly, to color field emission display devices.

BACKGROUND OF THE INVENTION

Field emission displays include an anode and a cathode structure. The cathode is configured into a matrix of rows and columns, such that a given pixel can be individually addressed. Addressing is accomplished by placing a positive voltage on one row at a time. During the row activation time, data is sent in parallel to each pixel in the selected row by way of a negative voltage applied to the column connections, while selected pixels on the anode are held at a high positive voltage. The voltage differential between the addressed cathode pixels and the anode pixels accelerates the emitted electrons toward the anode.

Color field emission display devices typically include a cathodoluminescent material overlying an electrically conductive anode. The anode resides on an optically transparent frontplate and is positioned in parallel relationship to an electrically conductive cathode. The cathode is typically attached to a glass backplate and a two dimensional array of field emission sites is disposed on the cathode. The anode is divided into a plurality of pixels and each pixel is divided into three subpixels. Each subpixel is formed by a phosphor corresponding to a different one of the three primary colors, red, green, and blue. Correspondingly, the electron emission sites on the cathode are grouped into pixels and subpixels, where each emitter subpixel is aligned with a red, green, or blue subpixel on the anode. By individually activating each subpixel, the resulting color can be varied anywhere within the color gamut triangle. The color gamut triangle is a standardized triangular-shaped chart used in the color display industry. The color gamut triangle is defined by each individual phosphor's color coordinates, and shows the color obtained by activating each primary color to a given output intensity.

So long as the pixels are sufficiently large, relative to a given electron beam size, the color gamut available at the frontplate of the display is only limited by color output of a given phosphor. Under ideal operating conditions, electrons emitted by the addressed emitter subpixels on the cathode only strike the intended subpixel on the anode. However, in many practical systems of interest, such as high-voltage displays, the beam width of the emitted electrons is not confined to a particular subpixel on the anode. At the relatively large cathode to anode separation distances used in high voltage displays, the electron beam spreads and stray electrons can strike adjacent subpixels on the anode. This phenomenon is know as "color bleed." As the color bleed increases, the available color gamut of the display is decreased.

In addition to color bleed, misalignment of the anode to the cathode can degrade the color performance of a display. Any misalignment can cause some subpixels to receive a higher than intended electron beam intensity, while others receive a diminished electron beam intensity. Even a slight amount of misalignment shifts the color coordinates of each phosphor and can result in a reduction of the color gamut available from the display.

To overcome the loss of color gamut, switched anode techniques in combination with frame sequential addressing have been developed. A switched anode provides separate circuits for subpixels of the same color, but located in adjacent pixels. The groups of subpixels on the anode are electrically connected to form two separate networks. An electronic control system is provided for sequentially addressing alternating rows and columns of pixels on the anode and on the cathode. Adjacent pixels are assigned an odd or even designation in order to separate the activation of the same color subpixels located in adjacent pixels on the anode. This approach significantly improves color performance, but at the expense of additional complexity and cost in the fabrication of the electronic circuitry necessary to operate the display.

Another method used to overcome color bleed is to add additional electrodes in the cathode to focus the emitted electron beam. The electron beam spreading is controlled by electrostatically confining the electron beam, such that the beam strikes the intended subpixel on the anode.

While the switched anode techniques and additional focusing structures improve color performance, these can be difficult to implement in a high voltage display and they require more complicated electronics, which add to the expense of the display. Furthermore, additional processing steps are often necessary, which increase the manufacturing cost of the display. Accordingly, a need existed for a low-cost, color field emission display having improved color performance.

Figure 1:
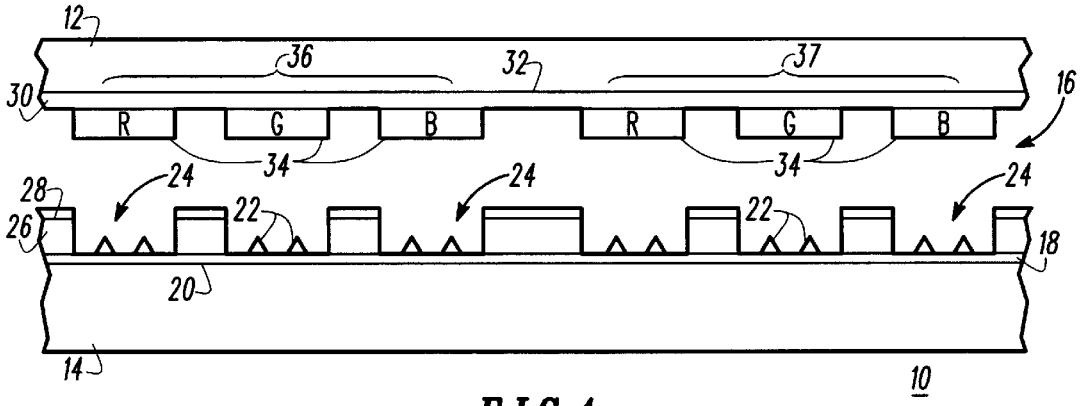
FIG. 1 illustrates, in cross-section, a portion of a field emission display fabricated in accordance with the prior art.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DETAILED DESCRIPTION OF PREFERRED EMBODIMENTS

The present invention is for a flat panel display device having improved color performance for a given cathode to anode alignment range. In the flat panel display of the invention improved color performance is obtained, in part, by selectively specifying the size distribution and the separation distances of red, green, and blue subpixels arrayed on the anode of the display. A plurality of emitter pixels are located on a cathode element of the display and aligned in spaced relationship to the red, green, and blue subpixels on the anode. Each subpixel is characterized by a specific surface area and location on the anode.

Because of the difference in relative light producing efficiencies of the various phosphors, a given amount of current spill over from one subpixel to an adjacent subpixel will have differing visual effects in display. For example, the green phosphor is typically has the highest light producing efficiency, while the blue phosphor has the least. As a result of the different efficiencies, if 10% of the electron beam current directed at the green subpixel spills over into the blue subpixel, the visual effect would be minimal. However, if 10% of electron current directed at the blue subpixel spills over into the green subpixel, the blue color coordinate of the display will be significantly degraded.

In the present invention, the distances from the emitting tips located on the cathode (for each color of subpixel on the anode) to adjacent subpixels is arranged so as to maximize the distance for those subpixels most sensitive to the current spill over (e.g. green). Enhanced color performance from a flat panel display fabricated in accordance with the invention is obtained by providing a nonuniform spacing of subpixels. For example, each red subpixel is laterally shifted along the surface of the anode in a direction toward each green subpixel and away from each blue subpixel. The lateral shift is measured with respect to the center point of emitter subpixels positioned on the cathode and arranged in paired relation to each of the red, green, and blue subpixels. In forming subpixels to have a surface area and position determined by the light emission efficiency of the particular phosphor, the invention provides a display having improved color performance. Additionally, a specified spacing arrangement red, green, and blue subpixels relative to the emitter subpixels located on the cathode reduces color bleed and increases the misalignment tolerance of the display.

To further enhance color performance, the area ratios of the red, green, and blue subpixels can be adjusted depending upon the particular phosphor, and the desired white color coordinate. In particular, the blue subpixels arrayed on the anode of a display formed in accordance with the invention have a larger surface area than either the red subpixels or the green subpixels. Additionally, the red subpixels have a greater surface area on the anode than the green subpixels. Accordingly, anodes fabricated in accordance with the invention contain a plurality of subpixels, in which the surface area of each blue subpixel in greater than the surface area of each red subpixel, and the surface area of each red subpixel is greater than the surface area of each green subpixel.

FIG. 1 is a partial cross-sectional view of a flat panel display device (10) fabricated in accordance with the prior art. A front plate (12) is arranged in parallel opposed position to a back plate (14) and defines a vacuum region (16) intermediate to front plate (12) and back plate (14). A cathode layer (18) overlies and inner surface (20) of back plate (14). A plurality of electron emitters (22) are electrically coupled to cathode layer (18) and reside within a plurality of emitter wells (24), emitter wells (24) are formed by openings fabricated within a dielectric layer (26) overlying cathode layer (18). A gate electrode layer (28) overlies dielectric layer (26) and anode layer (30) overlies an inner surface (32) of front plate (12). A plurality of phosphors (34) are arrayed on anode layer (30) and each phosphor is positioned in paired relationship with one of the plurality of emitter wells located on cathode layer (18).

In FIG. 1, each phosphor is designated as either red (R), green (G), or blue (B). The red, green, blue phosphors are arranged in a specific order on anode layer (30), such that red-green-blue triads are formed on the anode. In keeping with nomenclature commonly used in the art, each red-green-blue triad defines a pixel (or picture element) (36) on the anode of the display. Correspondingly, each phosphor defines a red, green, or blue subpixel (38) within each pixel (36).

In operation, a negative voltage is applied to cathode layer (18) and a positive voltage is applied to selected gate electrodes (28). Electrons accelerate across vacuum region (16) and are directed toward selected red, green, or blue phosphors by selectively applying a positive voltage to particular subpixels on anode layer (30). As electrons impinge upon phosphors (34), red, green, and blue light is emitted by the phosphors and is transmitted to the viewer through transparent front plate (12).

Figure 2:
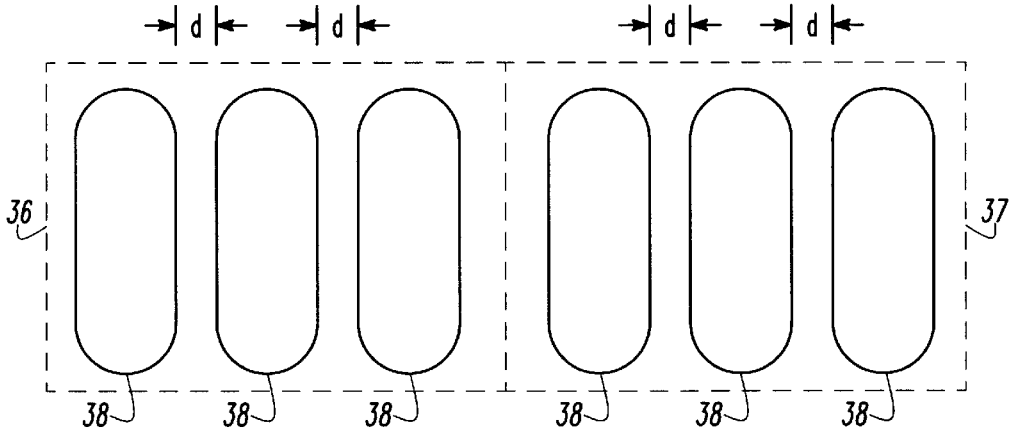
FIG. 2 illustrates, in plain view, adjacent pixels and subpixels arranged in accordance with the prior art.

FIG. 2 illustrates, in plain view, two adjacent pixels (36) and (37) each containing a red, green, blue, triad of subpixels (38) each subpixel (38) can be characterized by a surface area and by a spacing distance (d). Each of subpixels (38) are typically fabricated to have the same surface area on anode layer (30). Additionally, each of subpixels (38) are spaced the same distance (d) from each other.

The uniform size distribution and spacing distances of subpixels (38) results in a regular array of subpixels and pixels on anode layer (30). As previously described, a conventional grid arrangement, such as that illustrated in FIGS. 1 and 2, can suffer if electrons intended to impinge upon a particular phosphor diverge and strike an adjacent phosphor. Additionally, blue phosphors typically have lower emission efficiencies than do red or green phosphors. Increasing the electron current directed toward blue phosphors can further aggravate the problem of stray electron excitation. As noted in FIG. 1, the emitter wells (24) and electron emitters (22) within each of the wells are aligned in paired relation to an individual red, green, or blue phosphor. The direct paired alignment is intended to provide precise control of phosphor illumination, however, illumination of adjacent subpixels is difficult to avoid with the arrangement illustrated in FIGS. 1 and 2.

Figure 3:
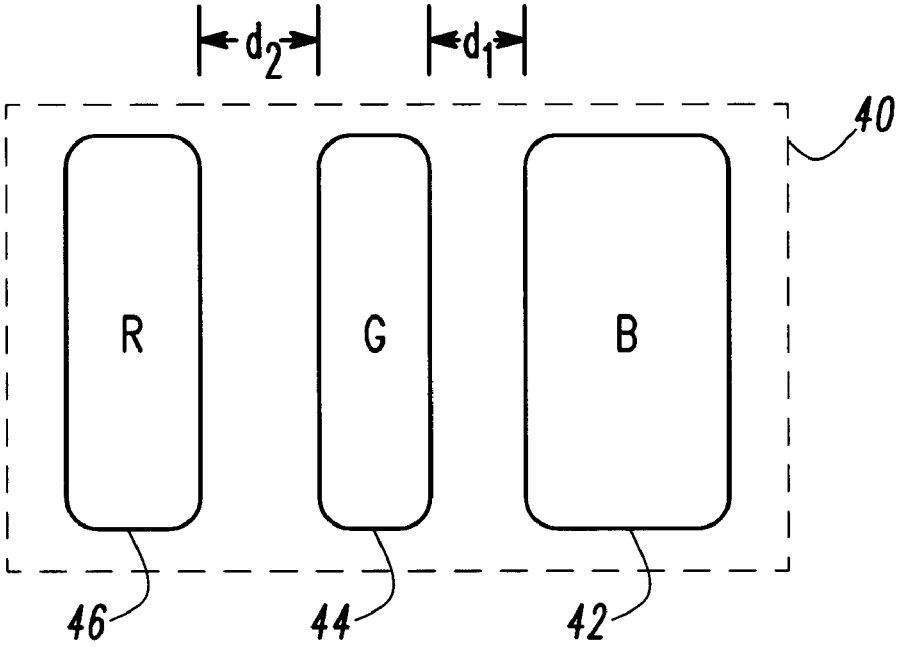
FIG. 3 illustrates, in plain view, an anode pixel containing red, green, and blue subpixels arranged in accordance with one embodiment of the invention.

FIG. 3 illustrates, in plain view, an anode pixel and associated subpixels arranged in accordance with the invention. Pixel (40) includes a blue subpixel (42), a green subpixel (44), and a red subpixel (46). In accordance with the invention, blue subpixel (42) has a larger surface area than either green subpixel (44) or red subpixel (46). Additionally, red subpixel (46) has a larger surface area than green subpixel (44). The hierarchy of subpixel surface areas is related to the emission efficiency of the cathodoluminescent material used to form red, green, and blue phosphors. The blue phosphor is less efficient than is the green phosphor or the red phosphor. Correspondingly, the green phosphor is more efficient than the red phosphor. Accordingly, the surface area of subpixels fabricated in accordance with the invention bears an inverse relationship to the light emission efficiency of the cathodoluminescent material used in red, green, and blue phosphors.

Additionally, subpixels fabricated in accordance with the invention do not have a uniform separation distance between adjacent subpixels. For example, as illustrated in FIG. 3, the edge of the green subpixel (44) is separated from the edge of blue subpixel (42) by a separation distance ($d_1$). Also, the opposite edge of green subpixel (44) separated from the edge of red subpixel (46) by a separation distance ($d_2$). The separation distances ($d_1$) and ($d_2$) are not equal. In one embodiment of the invention, the separation distance ($d_1$) between blue subpixel (42) and green subpixel (44) is less than the separation distance ($d_2$) between red subpixel (46) and green subpixel (44).

Figure 4:
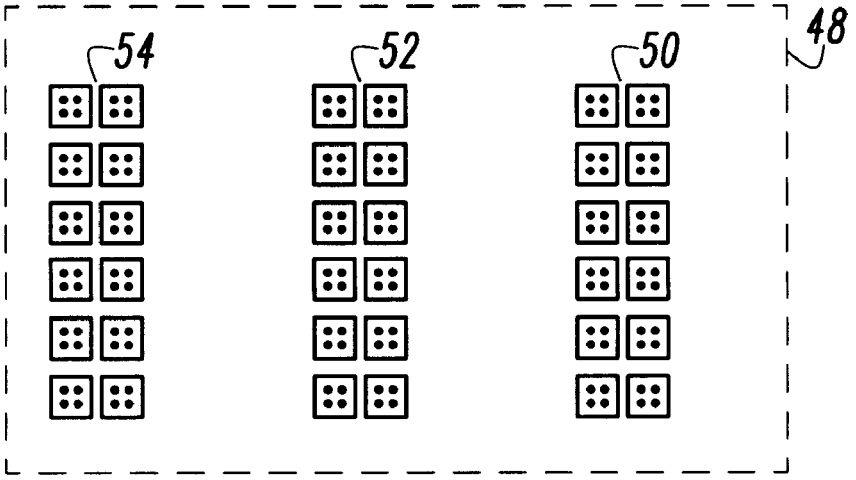
FIG. 4 illustrates, in plain view, an emitter pixel containing electron emitter groups arranged in accordance with one embodiment of the invention.

An emitter pixel (48) is illustrated in plain view, in FIG. 4. Emitter pixel (48) contains three groups of emitters subpixels (50), (52) and (54). In one embodiment of the invention, emitter subpixels (50), (52), and (54) are equidistantly spaced within emitter pixel (48). Although the emitter subpixels are illustrated having a uniform density of emitter sites, in another embodiment of the invention, the emitter site density can vary. For example, emitter subpixel (50) can have a high tip density than either emitter subpixel (52) or emitter subpixel (54).

Figure 5:
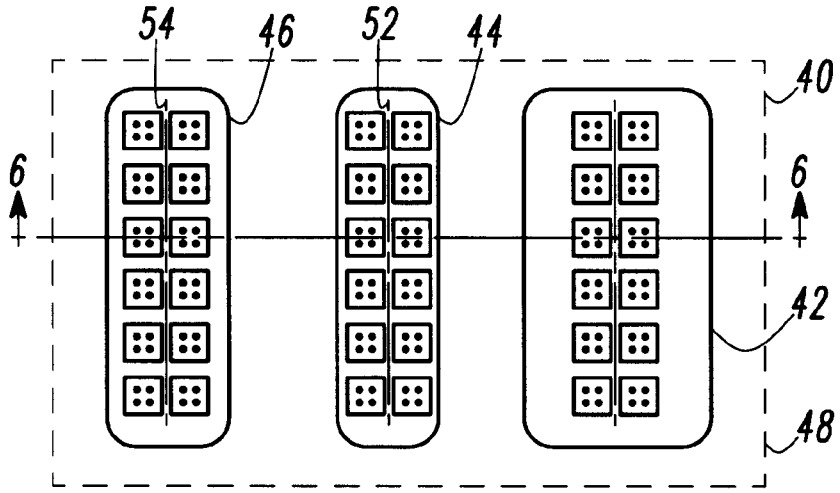
FIG. 5 illustrates, in plain view, a composite of an anode pixel aligned to an emitter pixel in accordance with the invention.

FIG. 5 illustrates, in plain view, a composite of pixel (40) overlying and aligned to emitter pixel (48). Subpixels (42), (44), and (46) are depicted as transparent in order to illustrate the alignment of electron emitter groups (50), (52), and (54) with subpixels (42), (44), and (46), respectively. In accordance with the invention, pixel (40) is aligned with emitter pixel (48), such that red subpixel (46) is horizontally shifted with respect emitter subpixel (54). In a preferred embodiment of the invention, red subpixel (46) is horizontally shifted toward green subpixel (44).

Figure 6:
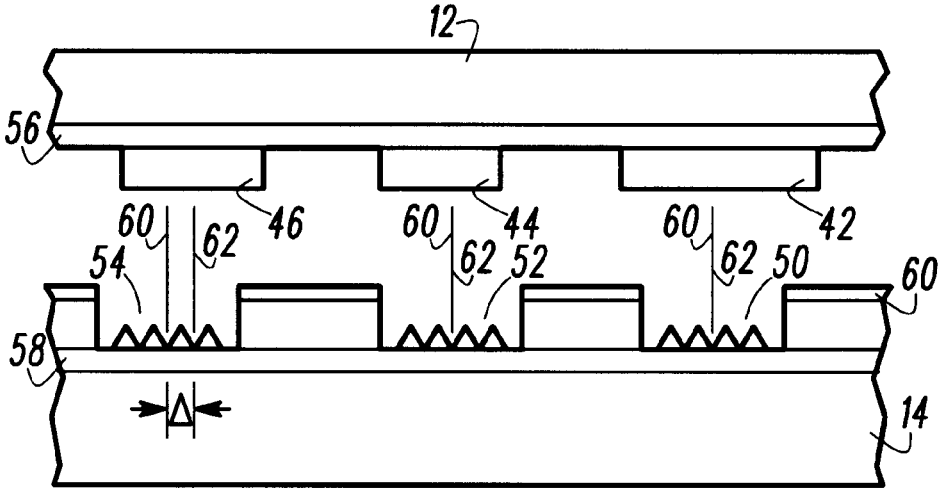
FIG. 6 illustrates, in cross-section, a flat panel display arranged in accordance with the invention and taken along section line 6—6 of FIG. 5.

FIG. 6 illustrates a cross-sectional view of a display (11) arranged in accordance with the invention. For purposes of illustration, display (11) is shown as a sectional of the anode and cathode pixel composite shown in FIG. 5 taken along section line 6—6. The cross-sectional view illustrates the alignment of an anode (56) with cathode (58) in accordance with the invention. Each of the emitter groups (50), (52), and (54) residing on cathode (58) are characterized by a center line (60). Subpixels (42), (44), and (46) disposed on anode (56) are also characterized by a center line (62). As indicated, center line (62) of blue subpixel (42) substantially the same as center line (60) of emitter group (50). Also, center line (62) of green subpixel (44) is substantially the same as center line (60) of emitter group (52). In contrast, center line (62) of red subpixel (46) is offset from center line (60) of emitter group (54). Accordingly, the center point of red subpixel (46) is laterally shifted away from the center point of emitter group (44) in a direction toward center point (62) of red subpixel (44).

In a representative display, pixels (40) are arrayed on anode (56) with a pitch distance of about 355 microns. Separation distance ($d_1$) between green subpixel (44) and blue subpixel (42) is about 45 microns. While the separation distance ($d_2$) between green subpixel (44) and red subpixel (46) is about 52 microns. In a preferred embodiment, the center point of red subpixel (46) is laterally shifted toward the center point of green subpixel (44) by a distance of about 7 microns. Those skilled in the art will appreciate that other dimensions and dimensional relationships are possible depending upon the overall size and density of the display.

In operation, electrons are extracted from emitter subpixels (50), (52), and (54) by applying appropriate potentials to gate electrode (60), cathode (58), and anode (56). In one embodiment, an electron spot size can be about 220 to 280 microns. In the representative display described above, the electron spot size is about 250 microns. The increase in surface area of blue subpixel (42), in conjunction with the horizontal shift of green subpixel (46), reduces the number of stray electrons that originate from emitter subpixel (50) from inadvertently striking the green subpixel located in a pixel (not shown) adjacent to pixel (40). Additionally, the increased surface area of blue subpixel (42) provides a large surface to receive electrons emitted by emitter subpixel (50). In one embodiment of the invention, for a uniform pixel length, the blue subpixel has a width of about 94 microns, while the red subpixel has a width of about 66 microns and the green subpixel has a width of about 52 microns.

Thus, a flat panel display fabricated in accordance with the invention provides blue subpixels with high illumination, while minimizing the excitation of green subpixels located adjacent to blue subpixels. The anode subpixel size variation and relative alignment with respect to emitters located on the cathode produces enhanced color balance in a field emission display. Furthermore, a display fabricated in accordance with the invention is capable of producing a default white point close to the desired D6500 value. Additionally, the offset alignment of the anode subpixels to the cathode subpixels results in an increased performance tolerance for variations in electron emissions spot size from the individual emitter subpixels on the cathode. Accordingly, the overall color balance of the display is improved.

Thus it is apparent that there has been provided, in accordance with the invention, a color flat panel display device that fully meets the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, electron emission can be provided by edge emitters or by a layer of an emissive material, such as diamond-like-carbon, or the like. It is therefore intended to include within the invention all such variations and modifications as fall within the scope of the appended claims and equivalents thereof.

I claim:

1. A flat panel display device comprising:

a cathode arranged in parallel opposed position to and vertically separated from an anode;

red, green, and blue subpixels sequentially disposed on the anode, wherein each subpixel is defined by a surface area on the anode, and wherein the surface area of the blue subpixel is greater than the surface area of the red and green subpixels, and wherein the surface area of the red subpixel is greater than the surface area of the green subpixel; and a plurality of electron emission sites disposed on the cathode in spaced relationship to the red, green, and blue subpixels.

2. The flat panel display device of claim 1, wherein the plurality of electron emission sites are grouped into a plurality of emitter subpixels, and wherein each emitter subpixel is defined by a center point, and wherein each red, green, and blue subpixel is defined by a center point and positioned in paired relationship to a designated emitter subpixel, and wherein the center point of the red subpixel is laterally shifted away from the center point of its designated emitter subpixel.

3. The flat panel display device of claim 2, wherein the horizontal shift of the red subpixel is in a direction toward the green subpixel and away from the blue subpixel.

4. A flat panel display device comprising:

an anode partitioned into a plurality of adjacent anode pixels; and a red, a green, and a blue subpixels sequentially disposed within each of the plurality of anode pixels, wherein each subpixel is defined by a surface area on the anode, and wherein the surface area of each blue subpixel is greater than the surface area of each red subpixel and each green subpixel, and wherein the surface area of each red subpixel is greater than the surface area of each green subpixel.

5. The flat panel display device of claim 4 further comprising:

a cathode arranged in parallel opposed position to and vertically separated from the anode;

first, second, and third emitter subpixels sequentially disposed on the cathode in paired relation to the red, green, and blue subpixels, respectively;

wherein each emitter subpixel is defined by a center point, and wherein each of the red, blue, and green subpixels are defined by a center point, and wherein the center point of the red subpixel is laterally shifted away from the center point of the first emitter subpixel.

6. The flat panel display device of claim 5, wherein the red, green, and blue subpixels are sequentially disposed on the anode, such that the red subpixel is adjacent to a blue subpixel and to a red subpixel, and wherein the center point of the red subpixel is laterally shifted away from the blue subpixel and toward the green subpixel.

7. The flat panel display device of claim 5 further comprising:

a plurality of emission tips within each emitter subpixel, wherein each emitter subpixel contains a number of emission tips, and wherein the number of emission tips is greater in the third emission well than in either the first or the second emission wells.

8. A flat panel display device comprising:

an anode having a plurality of sequentially arranged green, red, and blue subpixels, wherein the green subpixel is separated from the blue subpixel by a first separation distance, and wherein the red subpixel is separated from the green subpixel by a second separation distance, and wherein the first separation distance is less than the second separation distance.

9. The flat panel display device of claim 8 further comprising:

a cathode in parallel spaced relationship to the anode, the cathode having a plurality of emitter subpixels thereon, wherein a first emitter subpixel is aligned in paired relationship to a red subpixel, and wherein the first emitter subpixel is defined by a center point, and wherein the red subpixel is defined by a center point, and wherein the center point of the red subpixel is laterally shifted away from the center point of the first emitter subpixel.

10. The flat panel display device of claim 9, wherein each of the red, green, and blue subpixels is defined by a surface area on the anode, and wherein the surface area of each blue subpixel is greater than the surface area of each red subpixel and each green subpixel, and wherein the surface area of each red subpixel is greater than the surface area of each green subpixel.

* * * * *